US005388632A

United States Patent [19]

Bayliss

[11] Patent Number: 5,388,632

[45] Date of Patent: Feb. 14, 1995

[54] METHOD AND APPARATUS FOR CASTING ARTICLES

[75] Inventor: Colin R. Bayliss, Granger, Ind.

[73] Assignee: T & N Technology Limited, Warwickshire, England

[21] Appl. No.: 70,337

[22] PCT Filed: Dec. 13, 1991

[86] PCT No.: PCT/GB91/02229

§ 371 Date: May 26, 1993

§ 102(e) Date: May 26, 1993

[87] PCT Pub. No.: WO92/11104

PCT Pub. Date: Jul. 9, 1992

[30] Foreign Application Priority Data

Dec. 19, 1990 [GB] United Kingdom ..... 9027466

[51] Int. Cl.[6] ..... B22D 15/02; B22D 29/04

[52] U.S. Cl. ..... 164/131; 164/137; 164/122; 164/342; 164/348; 164/401; 164/DIG. 8

[58] Field of Search ..... 164/131, 133, 137, 122, 164/339, 342, 343, 346, 348, 401, DIG. 8

[56] References Cited

U.S. PATENT DOCUMENTS 3,472,308 10/1969 Lauth ..... 164/123

FOREIGN PATENT DOCUMENTS 0275177 7/1988 European Pat. Off. .

2163374 2/1986 United Kingdom .

*Primary Examiner*—P. Austin Bradley

*Assistant Examiner*—Erik R. Puknys

*Attorney, Agent, or Firm*—Nixon & Vanderhye

[57] ABSTRACT

A method and apparatus are described for the production of piston castings, and, in particular, a die construction and method of use thereof are described, the die having a crown forming part (18) separable from a skirt forming part (12). In the method, when solidification of the casting occurs to an extent at least enabling the separation of the skirt forming die part therefrom to be allowed, and the die parts (20, 22) are separated, the casting is retained by the crown forming part (18) of the die. After a subsequent process step, such as the solidification of the remainder of the piston casting, and or the cooling of the piston casting by an air blast (64), the solidified piston is removed from the crown forming part of the die. A plurality of crown forming die parts, and a single, common, skirt forming part of the piston casting die, may be provided, together with handling means for the plurality of crown forming die parts and for bringing said die parts consecutively into mating with the skirt forming die part.

4 Claims, 5 Drawing Sheets

FIG. 5
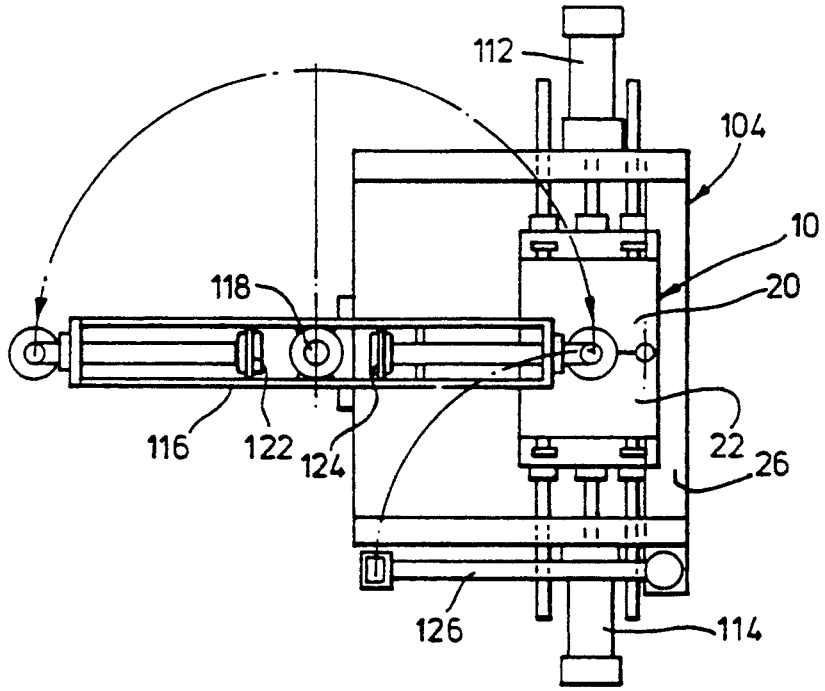
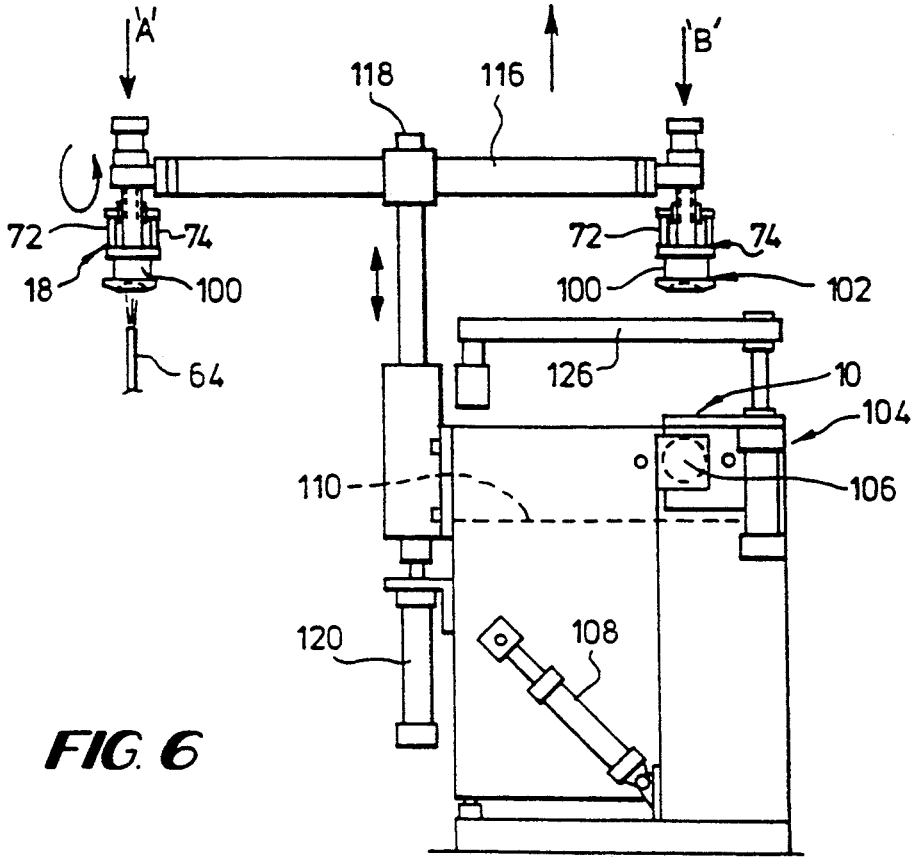
FIG. 6

METHOD AND APPARATUS FOR CASTING ARTICLES

The present invention relates to a method and apparatus for gravity die-casting articles particularly, pistons for internal combustion engines and compressors.

One method for the production of aluminium alloy pistons for internal combustion engines and compressors is the well known gravity die-casting technique, carried out in permanent, multi-piece dies, usually constructed of steel.

Pistons vary greatly in design, but generally comprise a skirt portion, having relatively thin metal section thicknesses; and a crown portion, having relatively thicker metal section thicknesses. The relative thicknesses of the skirt and crown metal sections also vary depending upon the type of piston in question. The differences in thicknesses between the two sections is a minimum for a small, monometal piston for a gasoline engine; and is a maximum for a large diesel engine piston which also embodies a combustion bowl in the crown and, for example, a cast-iron piston ring groove reinforcement.

Conventional die construction utilises a die body comprising two halves having a split line on a diametral plane of the die. The die halves form the generally cylindrical outer features of the piston; a multi-piece collapsible internal core forms the piston internal features; and a top plate or core, which rests on the top surface of the die halves, forms the piston crown surface features. Other die components such as core pins to form the bores of the gudgeon pin bosses may also be present. Further, encast items such as piston ring groove reinforcements also may be present, and if present are located in the closed die body halves before closure by the top plate.

Subsequently in this specification, and in the accompanying claims, reference is made to the die having a crown forming part, such as a top plate or core; and a skirt forming part. However, the crown forming die part also may be employed to form regions of the skirt contiguous with the crown; or the skirt forming die part also may be employed to form regions of the crown contiguous with the skirt. In particular, for convenience in this specification and in the accompanying claims, the term "skirt forming die part" is employed to refer to the constituent die part forming at least the major region of the piston skirt; and the term "crown forming die part" is employed to refer to the die part forming at least the major region of the crown.

Because of the differences in metal section thicknesses between the skirt and crown, the time to achieve complete solidification of each such piston portion varies. The relatively thin section skirt portion freezes first whilst the thicker section crown portion takes longer to solidify. Previously the rate of piston production from a conventional casting die has been governed by the time it takes for the crown portion to solidify, the casting not being able to be removed from the die until complete solidification has occurred.

A further disadvantage of conventional dies is that the top plate or core which closes the upper end of the die often becomes misaligned on die closure due to entrapped debris such as die flash or misalignment of die halves, for example. A consequence of this may be that the top surface of the as-cast piston is positionally inaccurate with respect to other piston features such as an encast ring groove reinforcement and gudgeon pin bosses, for example. Since the as-cast crown surface is often used as a datum for machining the piston, such casting inaccuracies can result in dimensional inaccuracies in the finish machined piston.

In order to improve the strength properties of cast pistons, they are sometimes subjected to a quenching operation immediately on removal from the die. Because it has been necessary to wait for sufficient time so as to ensure complete solidification of all parts of the piston before removal of the casting from the die, the temperature of at least a part of the casting has fallen to a level where such quenching operations are not as beneficial as they might otherwise have been.

It is an object of the present invention to provide a novel and advantageous casting method and apparatus.

According to a first aspect of the present invention there is provided a method for the production of a piston by casting, the casting including a skirt portion having generally relatively thin metal section thicknesses and a crown portion having generally relatively thicker metal section thicknesses, the method including the steps of pouring molten metal into a die, which die has a crown forming part separable from a skirt forming part, and the method is characterised by allowing solidification of the casting to an extent enabling the separation of the skirt forming part of the die therefrom, whilst the crown portion of the piston is partially molten separating said die parts so that the casting is retained by the crown forming part of the die, and after a subsequent process step removing the solidified piston from the crown forming part of the die.

One advantage of the method of the invention is an improvement in piston material properties when, in said subsequent process step, quenching is employed. One quenching technique is to use a direct air-blast quench. The provision of an air-blast quench underneath the piston encourages directional solidification of still molten metal of the crown portion towards the crown. Sounder castings, having improved properties due to the retention of some alloying elements in solution as a result of the more rapid solidification rate, may be produced. Subsequent precipitation heat treatments, on alloys which are amenable to such heat treatments, are consequently more effective in improving piston alloy properties.

According to a second aspect of the present invention there is provided apparatus for casting pistons, each of which pistons includes a skirt portion having generally relatively thin metal section thicknesses and a crown portion having generally relatively thicker metal section thicknesses, the apparatus comprising molten-metal pouring means, a piston casting die having a crown forming part and a skirt forming part, the arrangement being such that the crown and skirt forming die parts are separable from each other whilst the crown portion of the piston is partially molten, and the skirt forming part is removable to leave such a partially solidified casting retained by the crown forming part of the die, characterised in that there is provided a plurality of crown forming die parts and single, common, skirt forming part of the piston casting die, and the apparatus has handling means associated with the plurality of crown forming die parts and for bringing them consecutively into mating with the single, common, skirt forming die part.

Previously the output of pistons has been controlled by the time taken for the molten metal constituting the piston crown and/or riser to freeze. However, when a partially solidified casting is removed from the single, common, skirt forming part of the die, and completion of the solidification of the crown portion of such a first casting occurs whilst the casting is retained by the associated one of the plurality of crown forming die parts, at least one of the other provided crown forming die parts is mated with the single, common, skirt forming die part, and a further piston casting is produced, the arrangement is advantageous in increasing the piston output of the apparatus.

In a preferred embodiment of the apparatus, the die has associated register means to ensure that, in the complete die, the crown and skirt forming die parts are accurately mutually positioned to ensure axial accuracy of the features of the cast piston. When the skirt forming part of the die comprises two die halves, split at a piston cavity diameter, the die halves have crown die part location means within the die cavity and close about co-operating location means on the external surface of the crown die part to bring the skirt and crown forming parts into accurate mutual register. Such register means may comprise an internal annular recess of tapered cross section, formed when the die halves are closed, and a co-operating external flange on the crown forming die part, the crown and skirt forming die parts being locked together on closure of the skirt forming die halves.

In the case of pistons which have an encast piston ring groove reinforcement such as an annular Ni-Resist (trade mark) ring carrier, the apparatus of the present invention may be modified by the provision of ring carrier positioning and retention means with the crown forming die part.

Known automated molten metal metering and pouring means may also be advantageously used with the method and apparatus of the present invention.

In order that the present invention may be more fully understood, examples will now be described by way of illustration only with reference to the accompanying drawings, of which:

FIG. 5 shows a plan view of apparatus according to the present invention and including the die of FIG. 4; and FIG. 6 which shows a view in elevation of the apparatus of FIG. 5.

Figure 1:
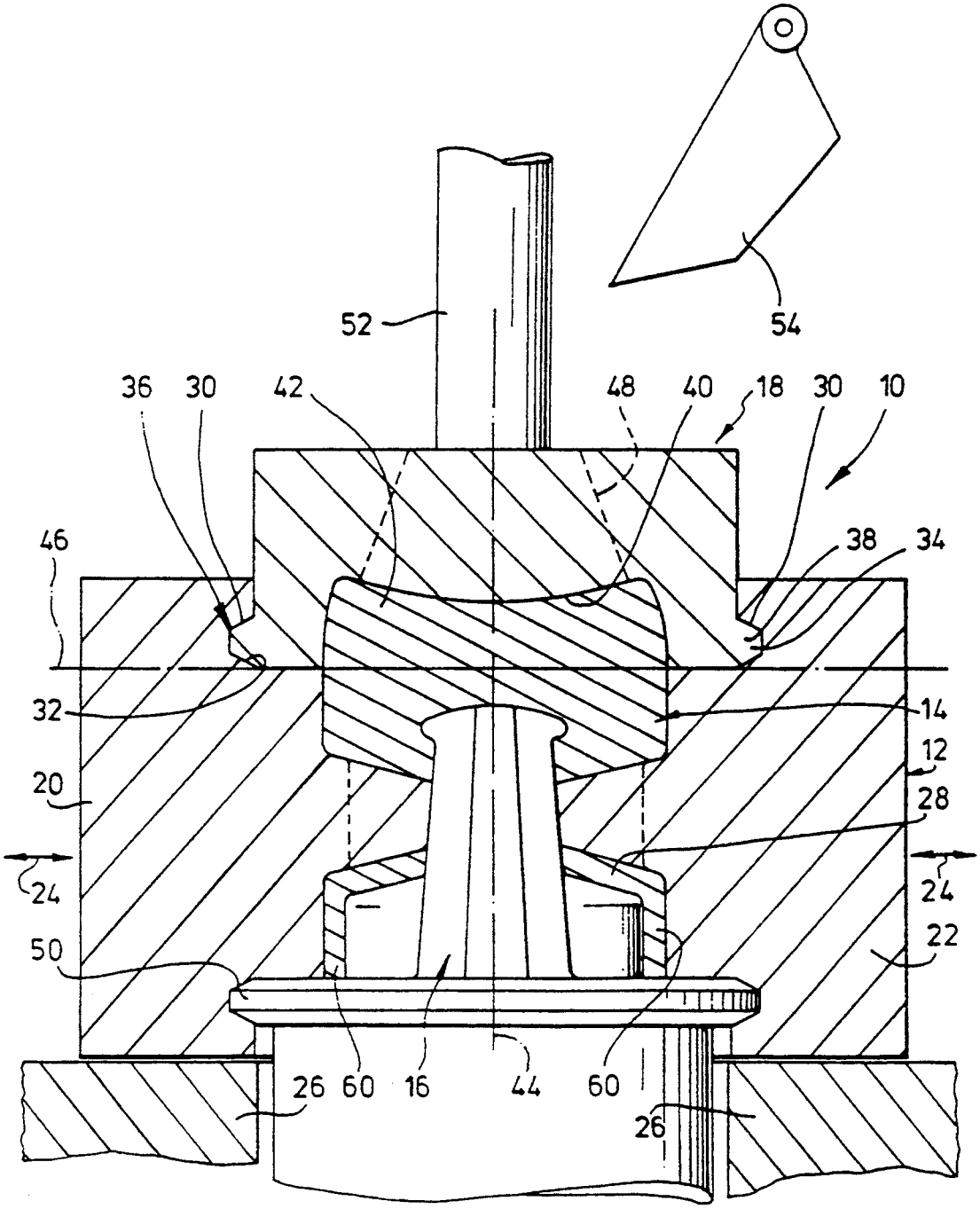
FIG. 1 shows a cross section in a diametral plane through a schematic representation of a piston casting die.
Figure 2:
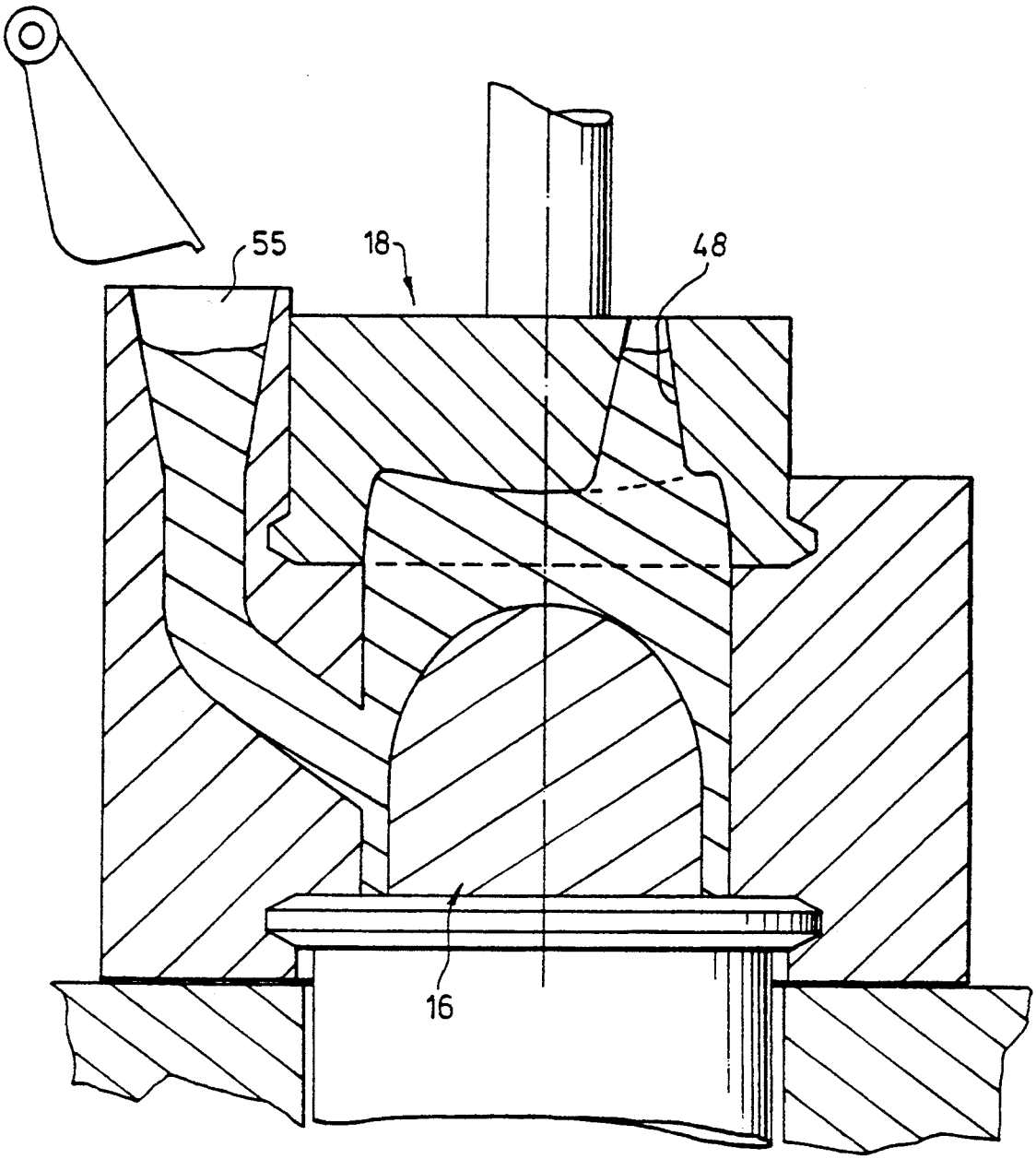
FIG. 2 shows a cross section in a diametral plane at 90° to the plane of the cross section of the piston casting die of FIG. 1.

Referring now to FIGS. 1 to 2, a die assembly is shown generally, and schematically, at 10; the assembly 10 comprises a female skirt forming die part 12 which produces the external skirt features of a piston 14, a male core member 16 which forms the piston internal features; and a crown forming die part, otherwise called a top core 18. The skirt forming part 12 itself comprises two die halves 20, 22 which are split along a diameter of the piston cavity in the plane of the section shown in FIG. 2. The two halves 20, 22 slide, under the action of pneumatic or hydraulic cylinders (such as are shown in FIGS. 5 and 6), in the directions indicated by the arrows 24 on a die table base plate 26. A representation of the member 16 is indicated, and comprises a conventional multi-piece collapsible core, and can be removed from the solidified skirt portion 28 of the piston where there are re entrant angles associated with the gudgeon pin bosses for example. Each die half 20, 22 has a semicircular recess 30 formed therein, each recess having a tapered 32, 34 cross sectional shape and, when the halves 20, 22 are mated together, the recesses 30 constitute a circular recess 36. The recess 36 co-operates with an external flange 38 on the top core 18 such that when the halves 20, 22 are closed together on the flange 38, the top core is accurately axially located relative to the die part 12. The top core 18 has a cavity 40 therein which provides at least a substantial proportion of the piston crown 42. The mould cavity split line between the die part 12 and the top core 18 is in a radial plane normal to the piston axis 44, and is indicated by the line 46. The top core 18 also embodies a molten metal riser 48, indicated by dashed lines in FIG. 1. A conventional die ring, indicated generally at is provided, and is employed to accurately axially locate core member 16 in the closed die cavity. A moving arm 52 connected to the top core 28, and the arm is movable to position the top core in the die 10; and to lift the top core, and piston casting 14, away from the opened die halves 20, 22.

In operation the die is assembled by first moving the die halve 20, 22 away from each other in the direction of the arrows 2. The top core 18 and internal core 16 are then moved to their approximate final positions in the assembly. The die halves 20 22 are then closed, and the cores 16 and 18 are adjusted precisely in their required positions. A metered quantity of a light alloy, such as an aluminium - silicon alloy, for example, is poured from an automated pour-cup 54 into the die cavity via a runner system 55. The relatively thinner metal section 60 of the skirt positions are the first to freeze whilst the relativity thicker crown portion 42 metal sections require longer to solidify.

Figure 3:
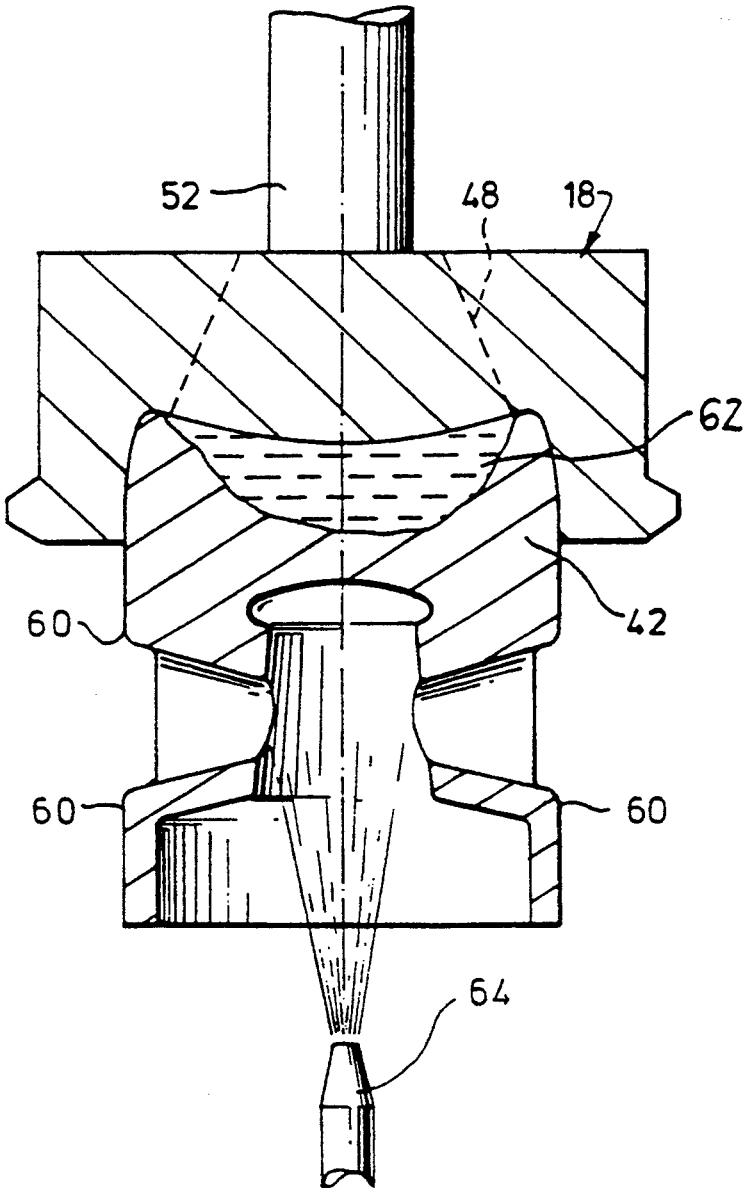
FIG. 3 shows, in accordance with the present invention, a partially solidified piston casting retained only by a piston crown forming die part.

For representational purposes only, in FIGS. 1 and 2 the piston casting 14 is shown as being wholly solidified in the complete die 12. The die halves 20, 22 then are able to be moved away from each other so as to be separated from the skirt portion 28 of the piston. However, in a method in accordance with the present invention, and as indicated also in FIG. 3, the die halves 20, 22 are separated from the skirt portion 28 of the piston when the skirt portion and contiguous regions of the crown portion 42 are solidified, but with the remainder of the crown portion still being molten. It is required that at least a region of the crown, sufficient to retain the partially solidified piston in the top core 18 without collapse of the metal, has solidified at this stage. The top core 18, together with the partially solidified piston 14, is moved away from the casting location by the arm 52. A subsequent process step is then performed on the casting whilst retained by the top core 18. For example, the casting 14 is quenched by an air blast from a jet 64 directed into the open end of the casting, such as is shown in FIG. 3. After this process step the solidified piston is removed from the top core. Thus, the remainder of the liquid metal 62 is allowed to freeze remote from the rest of the die assembly 16, 20, 22. However, the employment of such an air quench is not essential.

Figure 4:
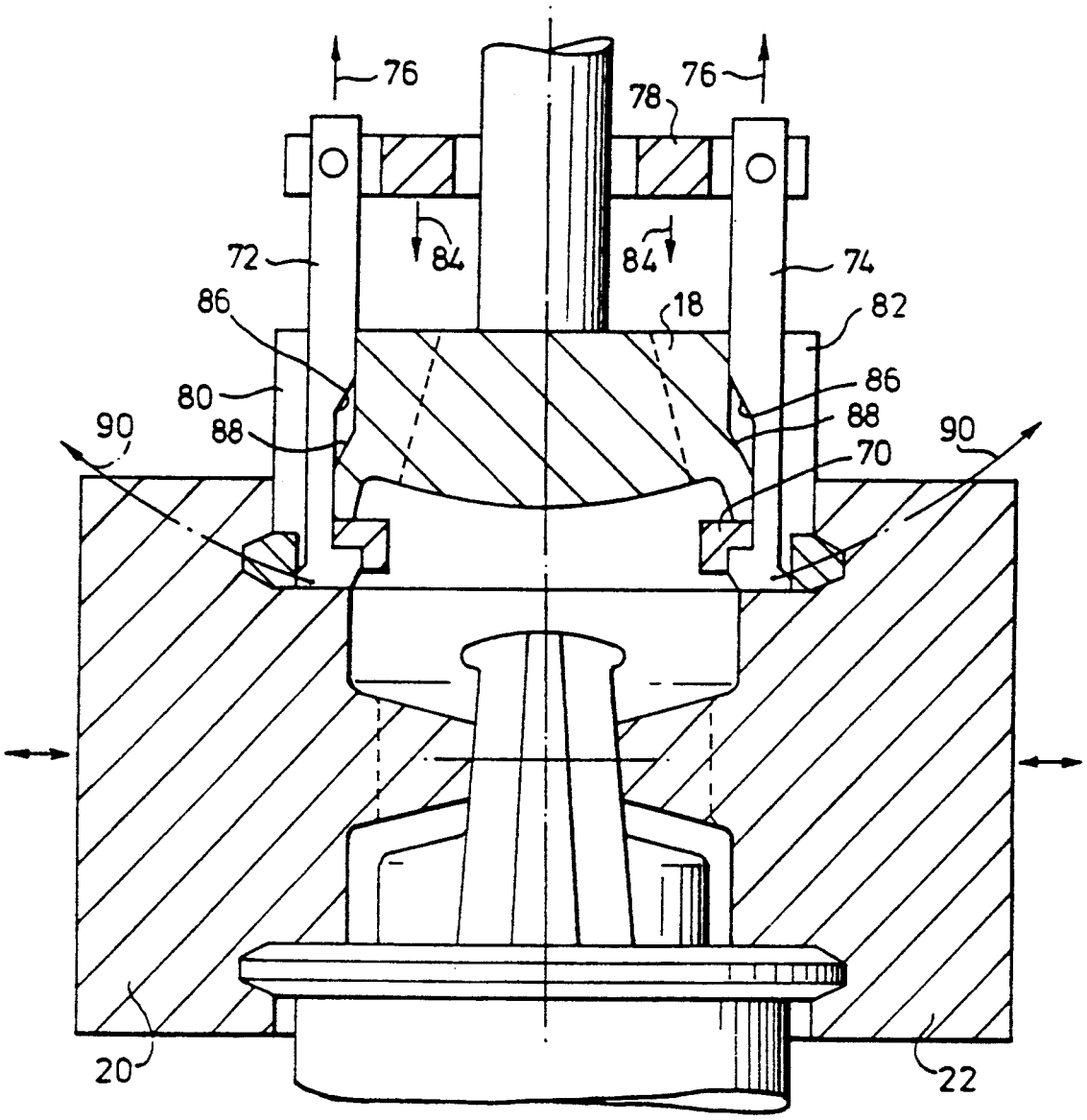
FIG. 4 shows a modified die to cast pistons each having a piston ring groove reinforcement.

FIG. 4 shows a modified piston casting die adapted to produce pistons having a piston ring groove reinforcement 70 incorporated therein. The reinforcement shown is a cast-iron piston ring carrier of the Ni-Resist (trade mark) type which is first preheated and coated with aluminium by dipping into a bath of molten aluminium according to the known Alfin (trade mark) method. The heated and coated piston ring carrier 70 is placed into the top core 18 before the core 18 is assembled into the die halves 20, 22. The ring 70 is retained in position by two (or more) fingers 72, 74 which are urged in the direction of the arrows 76 by a pneumatic cylinder and ram (not shown) acting upon the yoke 78; the fingers 72, 74 swing in slots 80, 82 machined in the top core 18. The remainder of the die construction and operation is essentially the same as that described above with reference to FIGS. 1 and 2, or FIG. 3. The fingers 72, 74 are eventually released from the completely solidified casting by being urged downwardly in the direction of the arrows 84 until the inclined surfaces 86 on the fingers and the inclined surfaces 88 on the top core engage causing the fingers to swing outwardly in the direction of the arrows 90.

FIGS. 5 and 6 show a largely automated apparatus for casting pistons 100, this apparatus being one embodiment of apparatus in accordance with the present invention. The apparatus includes two top cores 18,102 used alternately, and each to comprise part of a die of the construction described above with reference to FIG. 4. The apparatus also includes a fabricated frame 104 which is tiltable about an axis 106 by means of a pneumatic cylinder 108, to bring the runner 55 into position relative to the pour cup 54. This minimises pour cup movement thus simplifying the apparatus. The die assembly 10 slides on a base-plate table 26 which constitutes the upper surface of the frame 104. The die halves 20, 22 slide into engagement under the action of cylinders 112, 114. An arm 116, able to rotate about an axis 118, has the two top cores 18, 102 positioned with one at either end thereof. The top cores have fingers 72, 74 associated therewith for the positioning and retention of a piston ring groove reinforcement 70. The arm 116 is able to rotate through 180° and is also height positionable by means of a cylinder 120. Each top core 18, 102 may be rotated through 90° in a vertical plane by means of motors 122, 124 in the arm 116.

A pin-boss strut loading arm 126 may optionally be provided to load steel strut inserts (not shown) into the die cavity.

In operation, a piston ring groove reinforcement 70 is loaded at position "A" into top core 18. The loaded core is swung into position "B" about the axis 118 and lowered into a position whereby the die halves 20, 22 may be closed about the core 18. The machine frame 104 is then tilted about the axis 106 to allow the die to be filled from the pour cup 54 (see FIGS. 1 and 2). The skirt positions of the casting solidify first and allow a partially solidified casting to be removed from the die halves 20, 22 once opened (as described above with reference to FIG. 3).

The casting 100 is swung back to position "A" and simultaneously the other top core, 102, with a reinforcement 70, is positioned above the die at position "B" At "A" the casting is air blast cooled from the jet 64. Whilst a second casting is being poured and partially solidifying at "B", the first casting is fully solidified at "A", and released from the top core 18, which top core then received another ring groove reinforcement 70. The actions and sequencing of the above described apparatus operate under the control of known control systems.

Each combination of a top core and common skirt forming die part of the apparatus may have the construction shown in FIGS. 1 to 3, instead of that shown in FIG. 4.

More than two top cores may be provided in the apparatus, the handling means associated therewith being such that the top cores are brought consecutively into mating with the single, common, skirt forming die part of the apparatus.

I claim:

1. A method for the production of a piston by gravity die-casting, the casting including a skirt portion having generally relatively thin metal section thicknesses and a crown portion having generally relatively thicker metal section thicknesses, the method including the steps of:

(a) pouring molten metal into a die, which die has a first crown forming part separable from a skirt forming part; and (b) allowing the casting to solidify an extent enabling the separation of the skirt forming part of the die therefrom;

(c) separating said die parts while the crown portion of the piston is partially molten so that the casting is retained by the first crown forming part of the die; and (d) bringing a second crown forming part into mating with said skirt forming part;

(e) removing the solidified piston from the first crown forming part of the die.

2. A method according to claim 1 including the additional step between steps (c) and (d) of cooling the piston casting by an air blast.

3. Apparatus for gravity die-casting pistons, each piston including a skirt portion having generally relatively thin metal section thicknesses and a crown portion having generally relatively thicker metal section thicknesses, the apparatus comprising molten-metal gravity pouring means, a piston casting die having a plurality of crown forming die parts and a single, common skirt forming part, wherein the crown and skirt forming die parts are separable from each other while the crown portion of the piston is partially molten, and the skirt forming part, is removable to leave such a partially solidified casting retained by the crown forming part of the die, means for removing the skirt forming part from the piston casting die, and handling means associated with the plurality of crown forming die parts for bringing them consecutively into mating with the single, common skirt forming die part.

4. The apparatus as claimed in claim 3 wherein the skirt forming die part comprises two die halves, split at a piston cavity diameter, which die halves have crown die part location means within the die cavity and close about co-operating location means on the external surface of the crown die part to bring the skirt and crown forming parts into accurate mutual register.

* * * * *